US006951309B2

(12) United States Patent
Buschor et al.

(10) Patent No.: US 6,951,309 B2
(45) Date of Patent: Oct. 4, 2005

(54) POWDER SPRAY COATING DEVICE

(75) Inventors: Karl Buschor, St. Gallen (CH); Felix Mauchle, Abtwill (CH); Hanspeter Vieli, Rohrschach (CH); Silvano Gelain, Abtwill (CH)

(73) Assignee: ITW Gema AG, St. Gallen (CH)

( * ) Notice: Subject to any disclaimer, the term of this patent is extended or adjusted under 35 U.S.C. 154(b) by 157 days.

(21) Appl. No.: 10/213,448

(22) Filed: Aug. 7, 2002

(65) Prior Publication Data

US 2003/0042341 A1 Mar. 6, 2003

(30) Foreign Application Priority Data

Aug. 8, 2001 (DE) ..... 101 38 917

(51) Int. Cl.[7] ..... B05B 1/28; F23D 11/32; A62C 5/00

(52) U.S. Cl. ..... 239/290; 239/296; 239/690; 239/697; 239/698; 239/706; 239/708

(58) Field of Search ..... 239/290, 291, 239/292, 293, 294, 295, 296, 690, 697, 698, 706, 707, 708

(56) References Cited

U.S. PATENT DOCUMENTS

| | | | | |
|---|---|---|---|---|
| 3,977,607 A | * | 8/1976 | Kobayashi et al. | 239/145 |
| 4,289,278 A | | 9/1981 | Itoh | |
| 4,324,361 A | * | 4/1982 | Moos et al. | 239/292 |
| 4,659,011 A | * | 4/1987 | Moos | 239/290 |
| 4,772,982 A | * | 9/1988 | Nagasaka et al. | |
| 5,686,149 A | | 11/1997 | Buhlmann | |
| 5,800,876 A | | 9/1998 | Borner et al. | |
| 5,839,669 A | | 11/1998 | Borner et al. | |
| 5,928,731 A | * | 7/1999 | Yanagida et al. | |
| 6,053,420 A | | 4/2000 | Ahlbert et al. | |

FOREIGN PATENT DOCUMENTS

| | | | |
|---|---|---|---|
| DE | 27 22 100 | * | 11/1978 |
| DE | 36 08 426 | | 11/1994 |
| DE | 195 02 522 | | 8/1996 |
| DE | 195 37 089 | | 4/1997 |
| DE | 195 42 863 A1 | | 5/1997 |
| DE | 196 06 214 | | 8/1997 |
| DE | 196 14 192 | | 10/1997 |
| EP | 1 008 392 A2 | | 6/2000 |

* cited by examiner

*Primary Examiner*—Michael Mar
*Assistant Examiner*—Darren Gorman
(74) *Attorney, Agent, or Firm*—Lowe Hauptman & Berner, LLP

(57) ABSTRACT

A powder spraycoating apparatus includes at least one compressed-air outlet (8) connected to a source (14) of compressed air from which it receives compressed air (15) at such a rate and such pressure that the compressed air at the compressed-air outlet (8) shall detach the powder's rim layer from the powder duct (4) and shall concentrate the powder flow toward the radial flow center and make it swirl, at a site near the downstream end (6) of the powder duct (4).

7 Claims, 4 Drawing Sheets

POWDER SPRAY COATING DEVICE

FIELD OF THE INVENTION

The present invention relates to a powder spray coating apparatus and a powder spray coating method.

BACKGROUND OF THE INVENTION

U.S. Pat. No. 4,289,278 shows two different powder spraycoating devices of this kind wherein an annularly slotted compressed-air outlet issues into the powder duct upstream and/or downstream of a support-offset for a high-voltage electrode. The coating powder is sprayed by means of flow detachment at the end of the powder duct and/or by means of a funnel-shaped duct mouth and/or by a deflector or baffle configured at the center of the powder flow downstream of the powder duct. Said baffle may be fitted with one or more high-voltage electrodes to electrostatically charge the coating powder, whereas an electrode situated in the air flow from the compressed air outlet is grounded, as a result of which unipolar corona discharge takes place from the high-voltage electrode to the grounded electrode.

The German patent document 195 42 863 A1 shows a powder spraycoating device comprising a grounded electrode configured centrally in the powder flow and further downstream from said electrode high-voltage electrodes that inwardly project from the powder duct wall. The electrodes may be configured in an airflow in order to avoid having powder particles deposit on them. The European patent document 1 008 392 A2 shows a powder spraycoating device comprising a powder duct receiving an elongated central body in its downstream end zone, said body's downstream end segment flaring in funnel-like manner and together with the powder duct wall subtending a cross-sectionally annular powder duct segment. Compressed air is introduced into the powder duct, in particular into the cross-sectionally annular powder-duct segment, to generate compressed-air and powder eddies swirling around the central body.

SUMMARY OF THE INVENTION

The objective of the present invention is improving coating quality and coating efficiency.

In the present invention, quality of coating and coating efficiency are improved by better homogenization (rendering uniform) the powder particle distribution not only in the powder flow at the end of the powder spraycoating apparatus' powder duct but also and in particular in the subsequently generated spray jet or spray cloud. The rate or the pressure of the compressed air causing the powder flow to swirl in order to attain the said advantages is adjustable and/or it is regulated, preferably by a computerized control device and/or a power source, to feed the control devices of several powder spraycoating apparatus, depending on the practical equipment.

In the invention, the compressed air generates a kind of "compressed-air baffle" consisting of a substantially radial air drape crossing the full path of powder flow. Said air drape's flow and pressure are selected in such a way that the flow of compressed air entirely crosses the powder duct transversely and in this manner constitutes a kind of closed stop which may become an "open stop" by the pressure of the powder flow. In this mechanism the compressed air stop detaches the edge layer of the powder flow from the powder duct wall, furthermore it causes a radially inward displacement of the powder particles, and beyond the compressed air stop, it implements radially outward swirling as is attained at the back side of a mechanical stop.

Further features of the invention are stated in the dependent claims.

Accordingly the essential features of the claims of the invention are as follows:

1. A powder spraycoating apparatus comprising a powder duct for pneumatically conveyed coating powder to be sprayed at the downstream end of the powder duct, further comprising at least one air outlet enclosing the flow path defined by the powder duct and directed transversely to the path of the powder flow, characterized in that the air outlet is connected to a source of compressed air and receives compressed air from it at such a rate and pressure that the air pressure at the air outlet detaches the powder boundary layer from the powder duct and concentrates the powder flow toward its radial center and making it swirl.

2. Powder spraycoating apparatus as claimed in claim 1, characterized in that the jet of compressed air issuing from the air outlet constitutes a flow stop for the flow of powder from said compressed air, this flow stop being closed and lending itself to be opened by the flow of powder.

3. Powder spraycoating apparatus as claimed in either of claims 1 and 2, characterized in that the air outlet is configured at the downstream powder duct end where the coating powder spraying begins.

4. Powder spraycoating apparatus as claimed in either of claims 1 and 2, characterized in that the air outlet is configured downstream from an offset running transversely through the powder duct and therein keeping in place a center body.

5. Powder spraycoating apparatus as claimed in one of the above claims, characterized in that a an element atomizing powder is situated downstream of the air outlet in the path of the powder flow.

6. Powder spraycoating apparatus as claimed in one of the above claims, characterized in that the compressed-air outlet is an annularly slot nozzle.

7. Powder spraycoating apparatus as claimed in one of claims 1 through 5, characterized in that the compressed-air outlet is constituted by a plurality of nozzle apertures configured annularly around the flow path of the powder duct.

8. Powder spraycoating apparatus as claimed in one of the above claims, characterized in that at least one electrode is mounted in such manner in the air path of the air outlet that the flow of compressed air from said outlet can flow around said electrode.

9. Powder spraycoating apparatus as claimed in one of the above claims, characterized in that the air outlet is directed radially from the outside to the inside into the powder duct's path of powder flow.

10. A method for powder spraycoating, wherein coating powder is pneumatically conveyed through a powder duct and shall be sprayed from said duct's downstream end, and wherein compressed air is conveyed through a compressed air outlet transversely to the flow path defined by the powder duct, characterized in that the compressed air is fed at such a rate and pressure to the air outlet that the compressed air at the air outlet shall detach the outer powder layer from the powder duct and shall concentrate the flow of powder toward its radial center, and the compressed air through the air outlet shall be introduced into the path of powder flow so closely to the powder duct's downstream end that the powder flow homogeneity produced by swirling shall be preserved until powder spraying begins.

BRIEF DESCRIPTION OF THE DRAWINGS

The invention is elucidated below in the form of illustrative embodiments and in relation to the attached drawings.

DETAILED DESCRIPTION OF THE PREFERRED EMBODIMENTS

Figure 1:
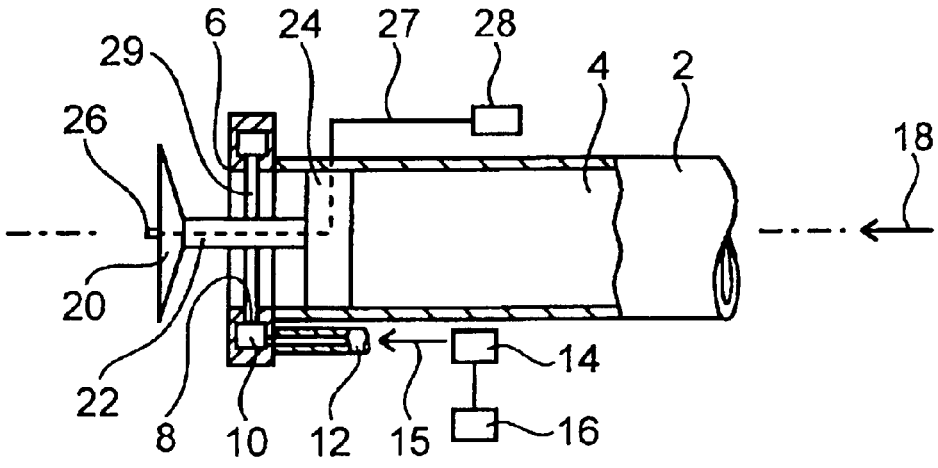
FIG. 1 is a schematic longitudinal section of a powder spraycoating apparatus of the invention.

FIG. 1 shows a spraycoating apparatus of the invention comprising a powder tube 2 defining a powder duct 4 fitted at its downstream end 6 with a compressed-air outlet 8 annularly enclosing the path of powder flow. The compressed-air outlet 8 may be in the form of a nozzle slot annularly enclosing the path of powder flow or in the form of a plurality of nozzle apertures annularly enclosing said path. FIG. 1 shows an annular nozzle slot. This annular nozzle slot communicates with an annular manifold duct 10 which is connected through a compressed-air line 12 to a source 14 of compressed air that may be for instance a compressed-air regulator, an adjustable compressed-air valve or a mains of compressed air. The compressed-air source 14 preferably is controlled by a computer-supported control unit 16 to adjust the pressure and the rate of compressed air 15 fed to the compressed-air outlet 8.

The coating powder is pneumatically conveyed in the form of a powder flow 18 through the powder duct 4 and then is sprayed or atomized at said duct's downstream end 6. Detachment of the powder flow from the rim of the aperture of the powder duct 4 may suffice to attain spraying or atomizing, and/or an additional atomizing element may be used, for instance an irrotational baffle 20 flaring in the downstream direction in conical or bell-shaped manner. The baffle 20 is configured at the front end of a support rod 22 which is affixed inside the powder duct 4 on a support offset 24. The widths of the support rod 22 and of the support offset 24 are substantially smaller than the diameter of the powder duct 4 and consequently the coating powder 18 is able to flow past them.

The compressed-air outlet 8 is situated downstream—as regards powder flow—from the support offset 24 which therefore cannot destroy the powder homogeneity produced by the flow of compressed air.

At least one high-voltage electrode 26 is configured in the powder's flow path upstream and/or downstream of the powder duct end 6 and is connected to a DC high-voltage source 28 to electrostatically charge the coating powder. Said source 28 may be situated inside or outside the powder spraycoating apparatus that typically is termed "spray gun" regardless of its being a handheld, pistol-like device or a machine-mounted system. Preferably said DC voltage shall be in the range from 10 to 140 kv.

FIG. 1 shows the minimum of one high-voltage electrode 26 at the center on the front side of the baffle 20. This electrode is connected by a high-voltage line 27 running through the support rod 22 and the support offset 24 to the high-voltage source 28.

One or several electrodes 29 may be configured in the flow of compressed air in the compressed-air outlet 8. Again such electrode(s) may be a high-voltage electrode connected to a high-voltage source such as electrode 16 or a grounded electrode to drain away electrical charges.

Figure 2:
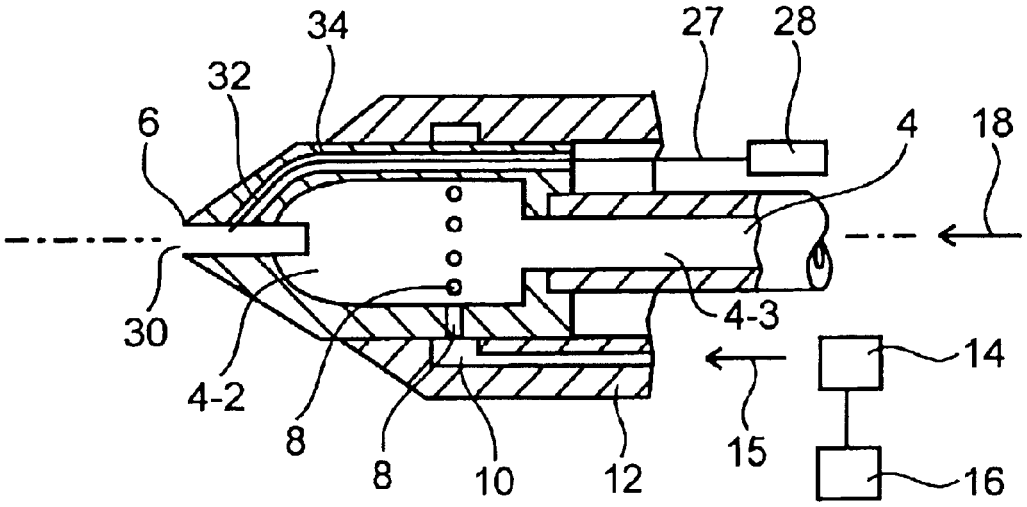
FIG. 2 is a schematic longitudinal section of another embodiment of the powder spraycoating apparatus of the invention.
Figure 3:
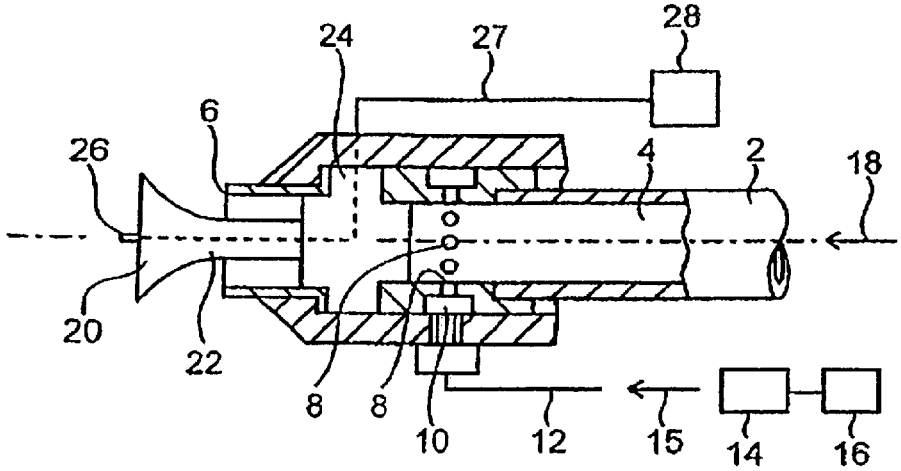
FIG. 3 is a schematic longitudinal section of another embodiment of the powder spraycoating apparatus of the invention.
Figure 4:
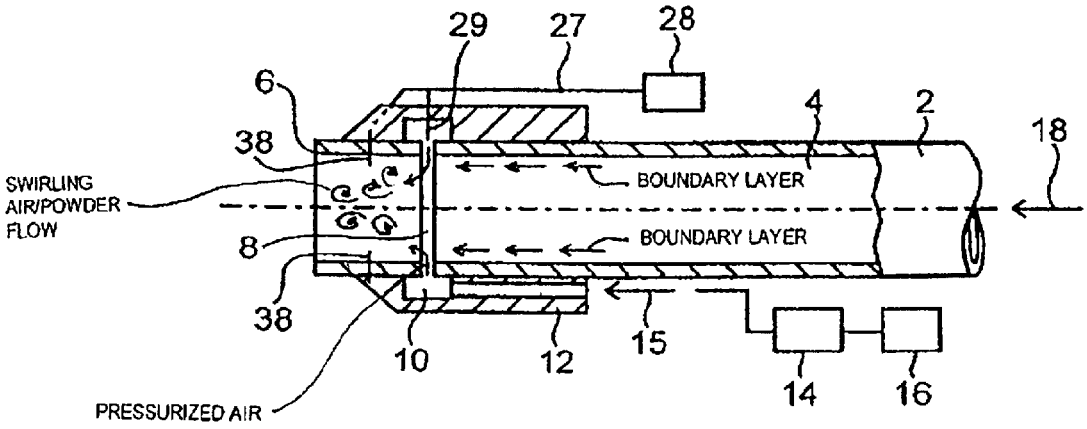
FIG. 4 is a schematic longitudinal section of yet another embodiment of a spraycoating apparatus of the invention.

Identical or functionally equivalent components are denoted by the same references in all FIGS. Therefore it is enough as regards to FIGS. 2 through 4 to only describe their differences relative to FIG. 1.

In FIG. 2, the compressed-air outlet 8 is constituted by a plurality of radial boreholes annularly enclosing the path of the powder at a downstream duct segment 4-2 of which the transmission cross-section is larger than that of an upstream duct segment 4-3 and which is free of internal parts such as the baffle supports 22, 24 of FIG. 1. The downstream end 6 of the powder duct 4 is constituted by a slot nozzle. Illustratively one high-voltage electrode 32 is mounted in the atomizing slot 30 of said slot nozzle. Said electrode 32 is connected through a high-voltage line 27 to a high-voltage source 28. The minimum of one high-voltage electrode 32 may be configured inside an air duct 34 transmitting compressed air into the flow of powder of the atomizer slot 30. Said compressed air may be fed from the compressed-air source 14, for instance by the intermediary of a pressure-reducing device, a pressure regulator or a throttling site.

The compressed-air outlet 8 is situated upstream of the support offset 24 in the embodiment of FIG. 3.

In FIG. 4, the powder is atomized by detaching the flow from the duct rim at the downstream end 6 of the powder duct 4. The compressed-air outlet 8 in this embodiment is only a short distance upstream of the downstream powder-duct end 6 and is designed as a slot nozzle. In other embodiment modes, however, a plurality of nozzle boreholes might be configured annularly. Several high-voltage electrodes 38 configured between the compressed-air outlet 8 and the downstream powder-duct end 6 project through the duct wall into the powder duct 4 to electrostatically charge the coating powder 18. Even though omitted from FIG. 4, said electrodes preferably are configured in air ducts as shown in FIG. 2 of which the compressed air prevents powder particles from depositing on the high-voltage electrodes 38.

Preferably all components except for the high-voltage electrodes, the high-voltage source 28, the compressed-air source 14 and the control unit 16 in all embodiments shall be made of an electrically insulating material.

The compressed-air outlet 8 preferably projects radially into the powder duct 4. In another embodiment mode, it may also slant toward or oppositely the direction of the powder flow 18.

The geometry of the compressed-air outlet 8 is such, and the compressed air is applied to it at such a rate and pressure that the powder's rim layer at the inner wall of the powder duct 4 shall be detached at the compressed-air outlet and the flow of powder shall be concentrated toward the radial flow center and made to swirl, as best seen in FIG. 4. The compressed-air outlet 8 is situated so close to the downstream end 6 of the powder duct 4 that the powder homogeneity produced by swirling shall be preserved until powder atomization shall begin at the powder-duct's end 6.

As shown by FIGS. 1 through 4, and in all embodiments, one compressed-air outlet 8, or, according to omitted embodiment modes, several compressed-air outlets 8 may be mounted in mutually axially sequential manner in the direction 18 of the powder flow.

According to the preferred embodiment of the invention, the compressed-air outlet shall be situated in such a zone of the powder duct 4 where said duct shall be free of intruding projections, whereby the compressed air shall be able to transversely flow across the full cross-section of the powder duct 4 as illustratively shown in FIGS. 2 through 4.

Figure 5:
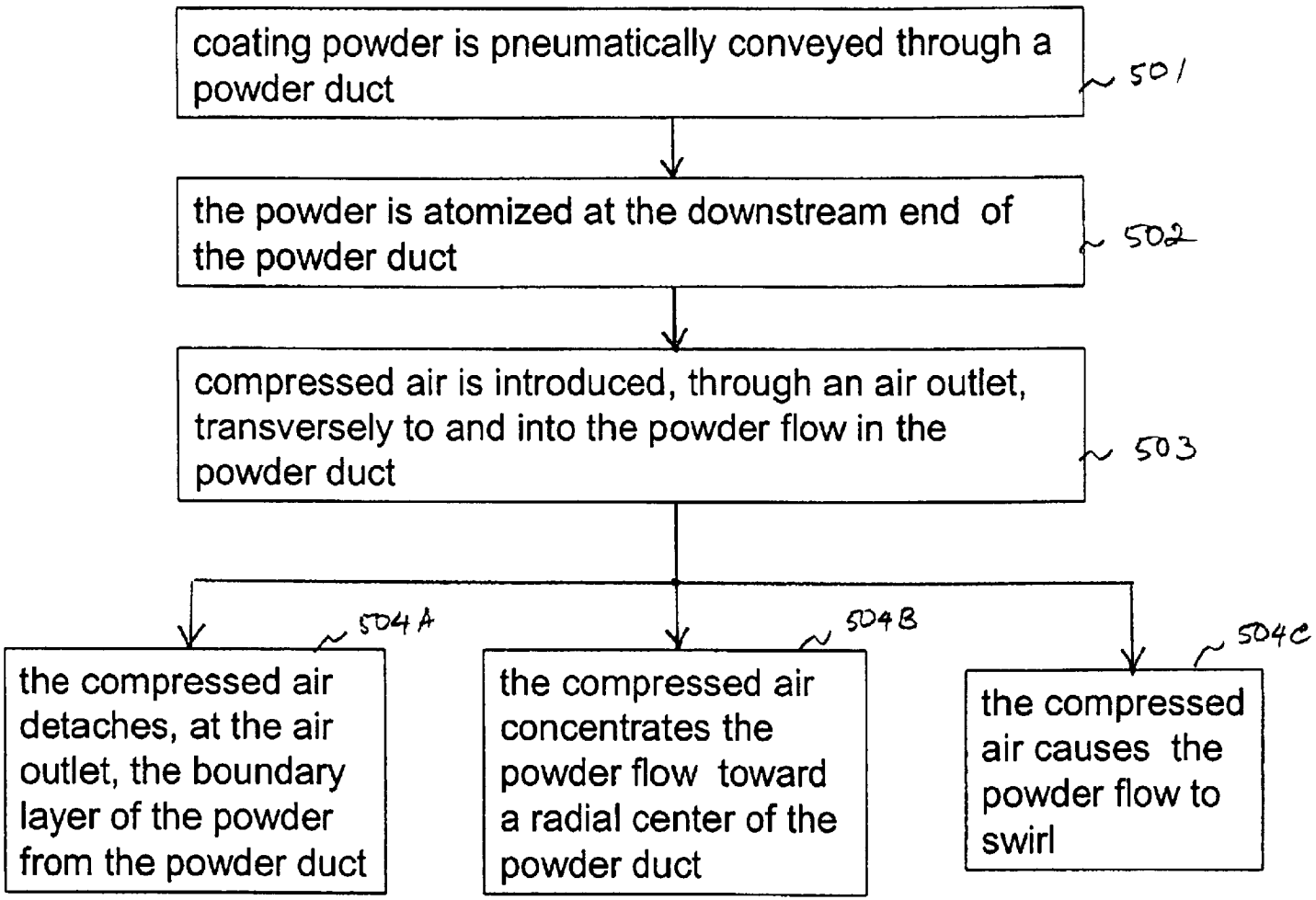
FIG. 5 is a block diagram schematically showing a powder spray coating method in accordance with an embodiment of the present invention.

FIG. 5 is a block diagram schematically showing a powder spray coating method in accordance with an embodiment of the present invention. As can be seen in box 501 of FIG. 5, coating powder is pneumatically conveyed through a powder duct (e.g., 4 in FIGS. 1–4). As can be seen in box 502 of FIG. 5, the powder is atomized at the downstream end (e.g., 6 in FIGS. 1–4) of the powder duct (e.g., 4 in FIGS. 1–4). As can be seen in box 503 of FIG. 5, compressed air is introduced, through an air outlet (e.g., 8 in FIGS. 1–4), transversely to and into the powder flow (e.g., 18 in FIGS. 1–4) in the powder duct (e.g., 4 in FIGS. 1–4). The compressed air is fed at such a rate and such pressure to the air outlet (e.g., 8 in FIGS. 1–4) that the compressed air (i) detaches, at the air outlet, the boundary layer of the powder from the powder duct as can be seen in box 504A of FIG. 5, (ii) concentrates the powder flow toward a radial center of the powder duct as can be seen in box 504B of FIG. 5, and (iii) causes the powder flow to swirl as can be seen in box 504C of FIG. 5.

Figure 6:
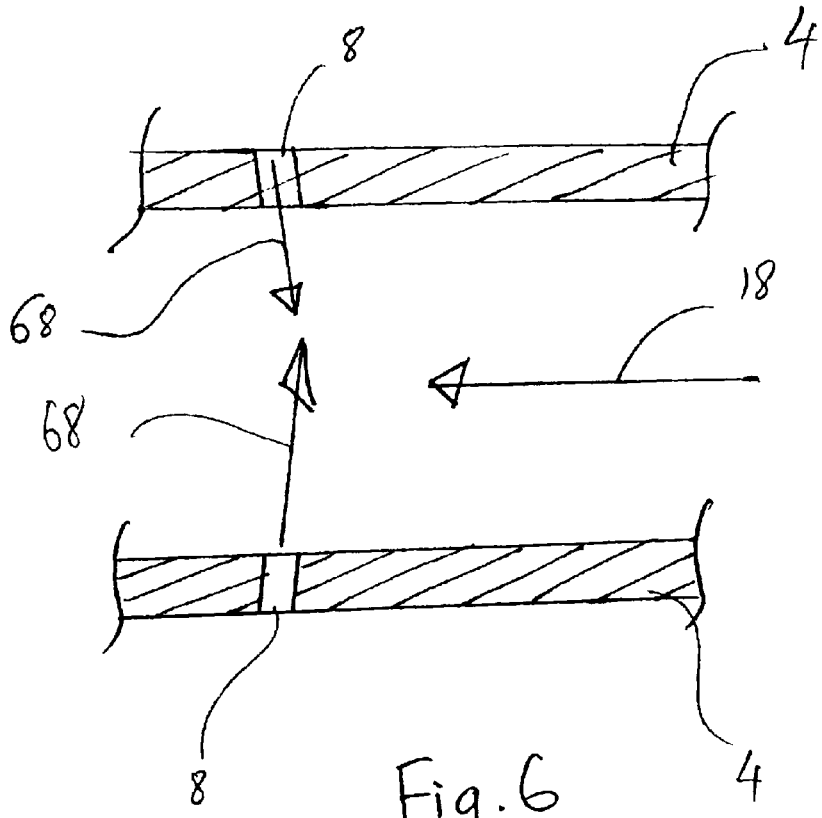
FIG. 6 is a fragmental sectional view showing an embodiment of the present invention.

FIG. 6 is a fragmental sectional view showing an embodiment of the present invention in which the air outlet 8, and hence the compressed air flow, is introduced substantially radially of the powder duct 4 and slanted in a direction 68 opposite, at least partially, to the flowing direction of the powder flow 18.

What is claimed is:

1. A powder spray coating apparatus, comprising:

a powder duct for pneumatically conveying coating powder to be sprayed at the downstream end of the powder duct; and at least one air outlet enclosing the flow path defined by the powder duct and directed toward the flow path;

wherein the air outlet is connected to a source of compressed air which feeds said compressed air at such a rate and pressure that said compressed air detaches a boundary layer of said powder from said powder duct at the air outlet, concentrating the powder flow toward a radial center of said powder duct and swirling said powder;

said air outlet is positioned upstream of the downstream end from which the powder is to be sprayed; and the compressed air outlet is an annular slot-nozzle.

2. A powder spray coating apparatus, comprising:

a powder duct for pneumatically conveying coating powder to be sprayed at the downstream end of the powder duct; and at least one air outlet enclosing the flow path defined by the powder duct and directed toward the flow path;

wherein the air outlet is connected to a source of compressed air which feeds said compressed air at such a rate and pressure that said compressed air detaches a boundary layer of said powder from said powder duct at the air outlet, concentrating the powder flow toward a radial center of said powder duct and swirling said powder;

said air outlet is positioned upstream of the downstream end from which the powder is to be sprayed; and the air outlet is directly radially, inwardly and perpendicular to the path of powder flow of the powder duct.

3. A powder spray coating method, comprising the steps of:

pneumatically conveying coating powder through a powder duct;

atomizing said powder at the downstream end of said powder duct; and introducing compressed air, through an air outlet, transversely to and into the powder flow in the powder duct wherein the compressed air is fed at such a rate and such pressure to the air outlet that said compressed air detaches the boundary layer of said powder from the powder duct at the air outlet and concentrates the powder flow toward a radial center of said powder duct and causes said powder flow to swirl;

the compressed air is introduced at such close proximity to the downstream end of the powder duct into the powder flow that the powder homogeneity in the powder flow generated by said swirling shall be preserved until powder atomization begins; and said compressed air is introduced radially of the powder duct and perpendicularly to the powder flow.

4. A powder spray coating method, comprising the steps of:

pneumatically conveying coating powder through a powder duct;

atomizing said powder at the downstream end of said powder duct; and introducing compressed air, through an air outlet, transversely to and into the powder flow in the powder duct wherein the compressed air is fed at such a rate and such pressure to the air outlet that said compressed air detaches the boundary layer of said powder from the powder duct at the air outlet and concentrates the powder flow toward a radial center of said powder duct and causes said powder flow to swirl;

the compressed air is introduced at such close proximity to the downstream end of the powder duct into the powder flow that the powder homogeneity in the powder flow generated by said swirling shall be preserved until powder atomization begins; and said compressed air is introduced substantially radially of the powder duct and slanted in a direction opposite to the flowing direction of the powder flow.

5. A spray coating apparatus, comprising:

a part defining an internal flow path along which a coating material is to be pneumatically conveyed, wherein said flow path terminates at a downstream end of said part from which downstream end the coating material is to be sprayed towards an object to be coated;

an air outlet open into said flow path at a location upstream of said downstream end for directing a compressed air flow into a flow of said coating material being pneumatically conveyed along said flow path; and a compressed air source connected to said air outlet for feeding said compressed air at such a rate and pressure that said compressed air flow detaches a boundary layer of said coating material from an internal wall of said part at the air outlet, thereby causing radially inward displacement of said coating material and, beyond said air outlet, imparts a radially outward swirl to said coating material flow;

wherein said air outlet is directed at a substantially right angle to said flow path.

6. A spray coating apparatus, comprising:

a part defining an internal flow path along which a coating material is to be pneumatically conveyed, wherein said flow path terminates at a downstream end of said part from which downstream end the coating material is to be sprayed towards an object to be coated;

an air outlet open into said flow path at a location upstream of said downstream end for directing a compressed air flow into a flow of said coating material being pneumatically conveyed along said flow path; and a compressed air source connected to said air outlet for feeding said compressed air at such a rate and pressure that said compressed air flow detaches a boundary layer of said coating material from an internal wall of said part at the air outlet, thereby causing radially inward displacement of said coating material and, beyond said air outlet, imparts a radially outward swirl to said coating material flow;

wherein said air outlet is directed in a radial direction perpendicular to said flow path.

7. A spray coating apparatus, comprising:

a part defining an internal flow path along which a coating material is to be pneumatically conveyed, wherein said flow path terminates at a downstream end of said part from which downstream end the coating material is to be sprayed towards an object to be coated;

an air outlet open into said flow path at a location upstream of said downstream end for directing a compressed air flow into a flow of said coating material being pneumatically conveyed along said flow path; and a compressed air source connected to said air outlet for feeding said compressed air at such a rate and pressure that said compressed air flow detaches a boundary layer of said coating material from an internal wall of said part at the air outlet, thereby causing radially inward displacement of said coating material and, beyond said air outlet, imparts a radially outward swirl to said coating material flow;

wherein said air outlet is directed substantially radially of the flow path and slanted in a direction opposite to the flowing direction of the coating material flow.

* * * * *